US006014985A

United States Patent [19]

Warshawsky

[11] Patent Number: 6,014,985

[45] Date of Patent: Jan. 18, 2000

[54] DROP-IN FAUCET VALVE

[75] Inventor: Jerome Warshawsky, Hewlett Harbor, N.Y.

[73] Assignee: IW Industries, Inc., Melville, N.Y.

[21] Appl. No.: 09/075,095

[22] Filed: May 8, 1998

Related U.S. Application Data

[63] Continuation-in-part of application No. 08/859,163, May 20, 1997

[60] Provisional application No. 60/043,989, Apr. 3, 1997.

[51] Int. Cl.[7] ..... F16L 5/00

[52] U.S. Cl. ..... 137/359; 137/801; 4/192

[58] Field of Search ..... 137/356, 360, 137/359, 801; 4/192; 285/240, 252

[56] References Cited

U.S. PATENT DOCUMENTS

| | | | |
|---|---|---|---|
| 2,818,878 | 1/1958 | Russell | 137/359 |
| 4,553,560 | 11/1985 | Tucker et al. | 137/359 |
| 4,662,389 | 5/1987 | Igbal | 137/359 |
| 5,349,987 | 9/1994 | Shieh | 137/801 |
| 5,853,024 | 12/1998 | Life | 137/359 |

*Primary Examiner*—A. Michael Chambers
*Attorney, Agent, or Firm*—Alfred Walker

[57] ABSTRACT

A drop-in faucet valve is installed from above a sink countertop. The drop-in valve includes an outer cylindrical sleeve having a diameter less than the diameter of a hole in the sink countertop. The valve itself is seated within the sleeve. The sleeve includes a water flow fitting portion such as a bottom or side fitting portion having a diameter less than or equal to the diameter of the sleeve. The water flow fitting portion engages a water flow conduit, and may include a female threaded portion engageable with a male threaded portion of a further water flow conduit such as a flexible outlet hose. The sleeve is dropped into the hole in the sink countertop. An escutcheon holds the sleeve in place above the sink countertop. A lock nut is threaded over the sleeve, up to the bottom of the countertop. The hose outlet is threaded to the outlet hole in the side fitting portion of the sleeve from under the sink.

8 Claims, 6 Drawing Sheets

DROP-IN FAUCET VALVE

RELATED APPLICATIONS

This application is a continuation-in-part of application Ser. No. 08/859,163, filed May 20, 1997 which is based upon provisional application Ser. No. 60/043,989 filed Apr. 3, 1997.

FIELD OF THE INVENTION

The present invention relates to sink counter mounted faucet valves.

BACKGROUND OF THE INVENTION

Because of space limitations under a sink counter, it is difficult to mount a faucet to a sink countertop. Generally, the as noted in FIG. 1, prior art installations include a sleeve communicating with a water supply below a sink countertop. The valve is seated within the sleeve, and the faucet handle is attached at a top end thereof, above the sink countertop.

The sleeve is attached to the countertop by a threaded lock nut which is threaded up the outer circumference of the sleeve, up to the bottom of the sink countertop.

Then, an elbow joint must be threaded to the bottom of the sleeve from below the sink countertop. The elbow has an outlet coupling side fitting which extends outward perpendicular to the sleeve, thus increasing the outer area of the valve by the extended distance of the outlet coupling side fitting.

An outlet hose is coupled to the outlet coupling side fitting for outlet of water. But because of the increased area, the faucet valve cannot be dropped in a hole in the sink countertop from above, resulting in installation in cramped conditions under the sink.

Therefore the sleeve and outlet coupling side fitting must be installed from below the sink countertop.

OBJECTS OF THE INVENTION

It is therefore an object of the present invention to provide a sink faucet valve which can be easily installed from above, through a hole in the countertop of a sink.

SUMMARY OF THE INVENTION

In keeping with these objects and other which may become apparent, the present invention relates to an improved drop-in faucet valve, which can be installed from above the sink countertop.

The valve includes an outer cylindrical sleeve having a diameter less than the diameter of a hole in the sink countertop. The valve itself is seated within the sleeve.

The sleeve includes a side fitting or bottom fitting portion having a diameter less than or equal to the diameter of the sleeve, wherein the side fitting or bottom fitting portion includes a female threaded portion engageable with a male threaded portion of a flexible outlet hose.

During installation, the sleeve is first attached to an upper escutcheon above the sink countertop, and dropped into the hole in the sink countertop. The escutcheon restrains the sleeve from going below a predetermined position within the hole, wherein an upper portion of the sleeve is exposed so that the upper handle engaging portion of the valve extends above the sink countertop.

The lock nut is threaded over the sleeve, up to the bottom of the countertop.

The hose outlet is threaded to the outlet hole in the side fitting or bottom fitting portion of the sleeve from under the sink.

DESCRIPTION OF THE DRAWINGS

The present invention can best be understood in conjunction with the accompanying drawings in which.

DETAILED DESCRIPTION OF THE DRAWINGS

Figure 1:
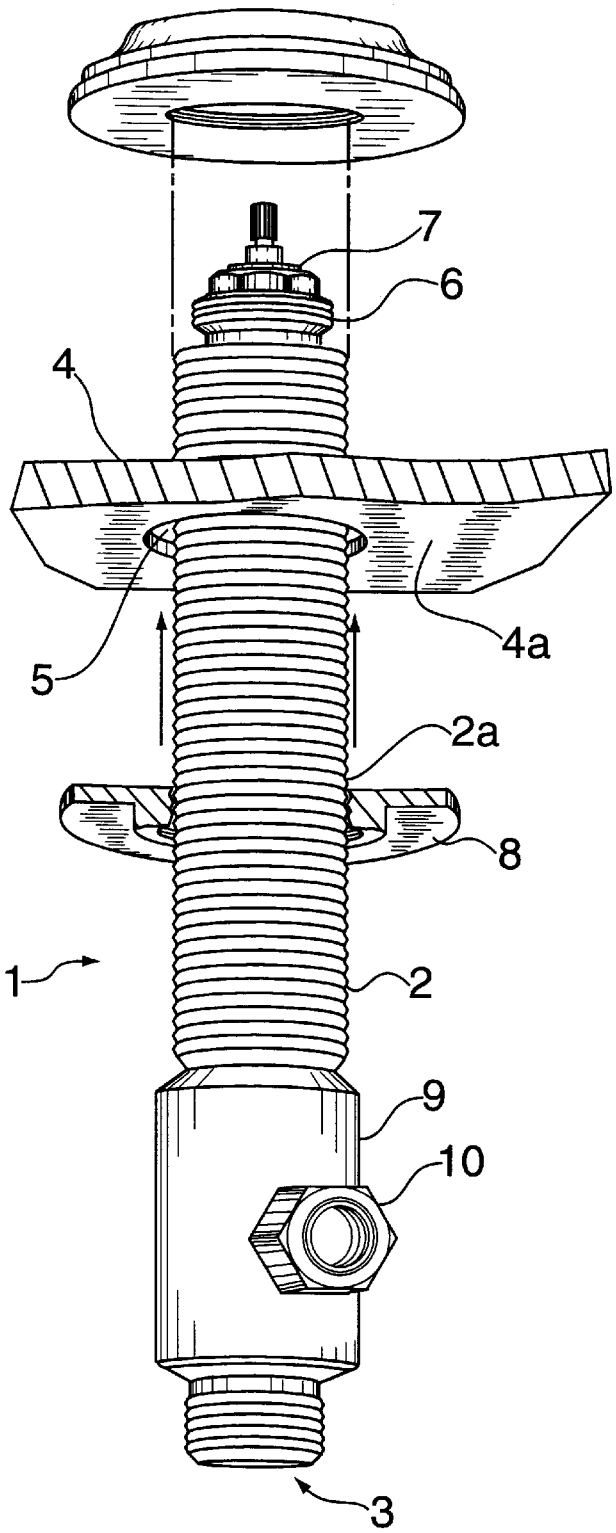
FIG. 1 PRIOR ART
FIG. 1 is an exploded perspective view of a prior art faucet valve assembly.
Figure 2:
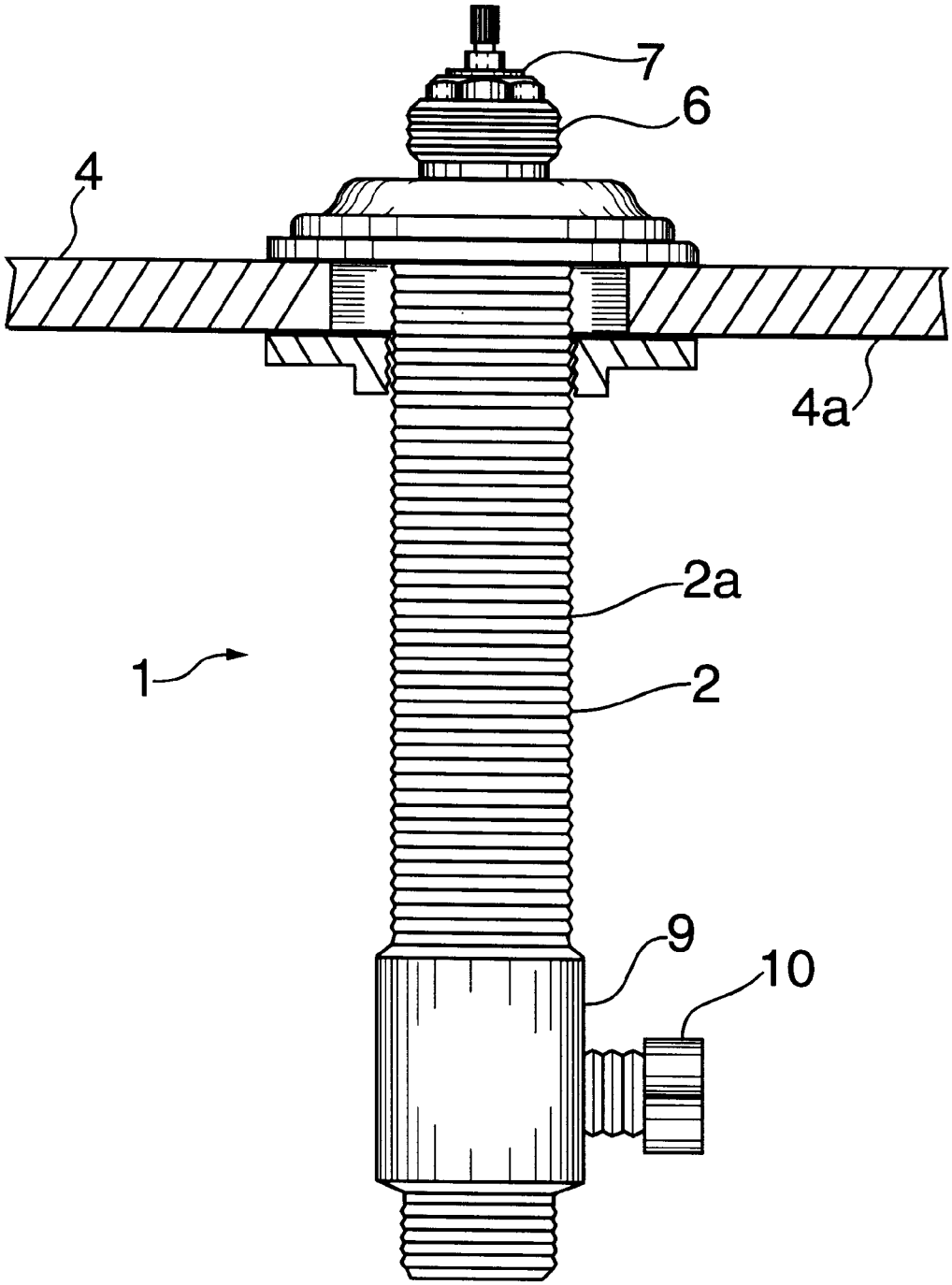
FIG. 2 PRIOR ART
FIG. 2 is a side elevational view of a prior art faucet valve assembly

As shown in FIGS. 1 and 2, a prior art faucet valve assembly 1 includes sleeve 2 connected to a water supply 3 below a sink countertop 4 through hole 5. Valve 6 is seated within sleeve 2, and a faucet handle (not shown) is attached at a top end 7 thereof, above the sink countertop 4. Sleeve 2 is attached to sink countertop 4 by threaded lock nut 8 which is threaded up the outer edge 2*a* of sleeve 2, up to a bottom 4*a* of sink countertop 4.

Outwardly extending side fitting 9 extends outward from outer edge 2*a* of sleeve 2. Side fitting 9 is threaded to bottom 2*b* of sleeve 2 from below sink countertop 4. Side fitting 9 includes outlet coupling 10 coupled to an outlet hose (not shown) for outlet of water.

Since side fitting 9 increases the diameter of sleeve 2, faucet valve assembly 1 cannot be inserted downward within hole 5 in the sink countertop 4 from above.

Therefore the sleeve 2 and side fitting 9 must be installed from below the sink countertop 4.

Figure 3:
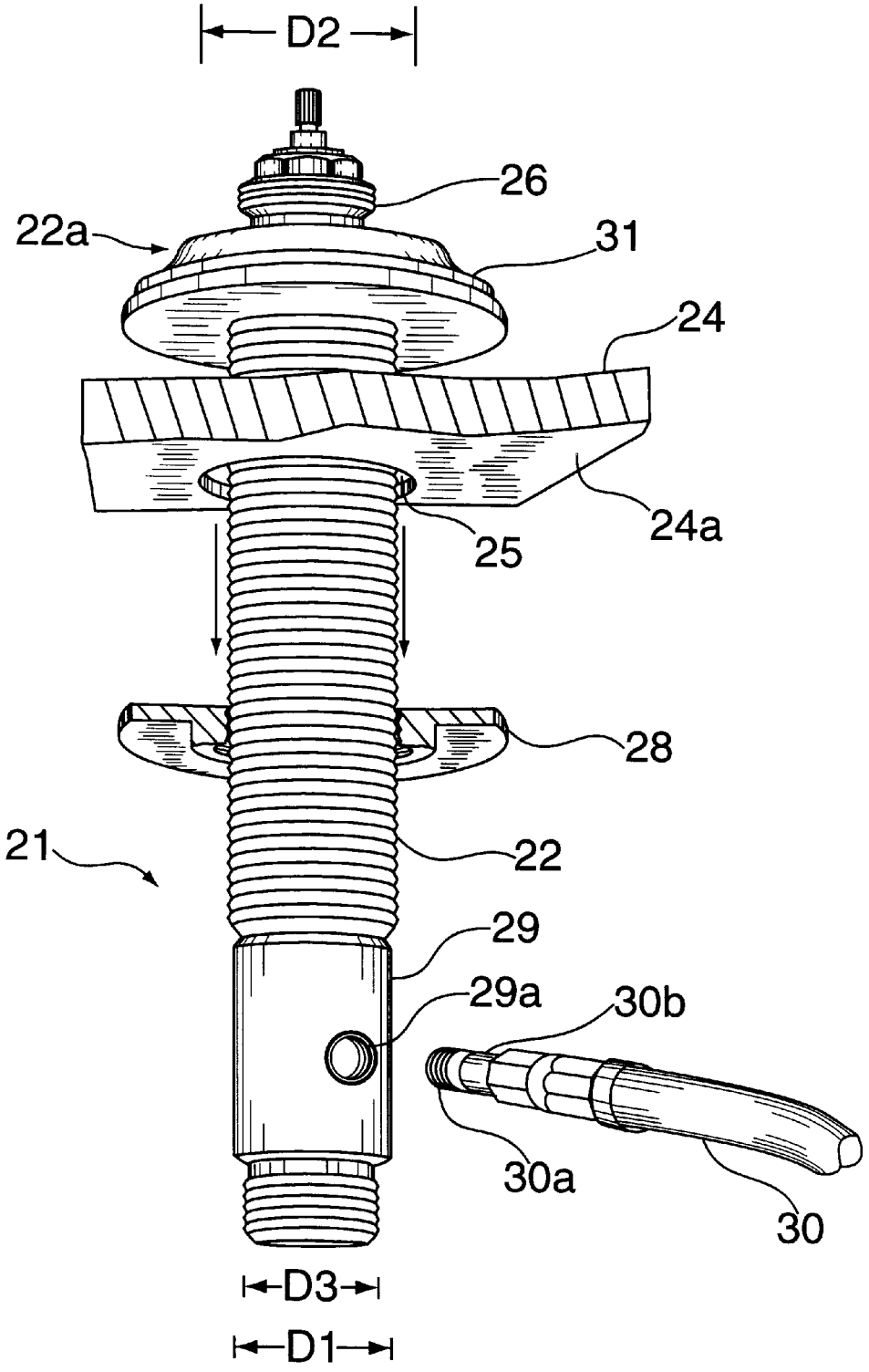
FIG. 3 is an exploded perspective view of one embodiment of the drop-in valve assembly of the present invention.
Figure 4:
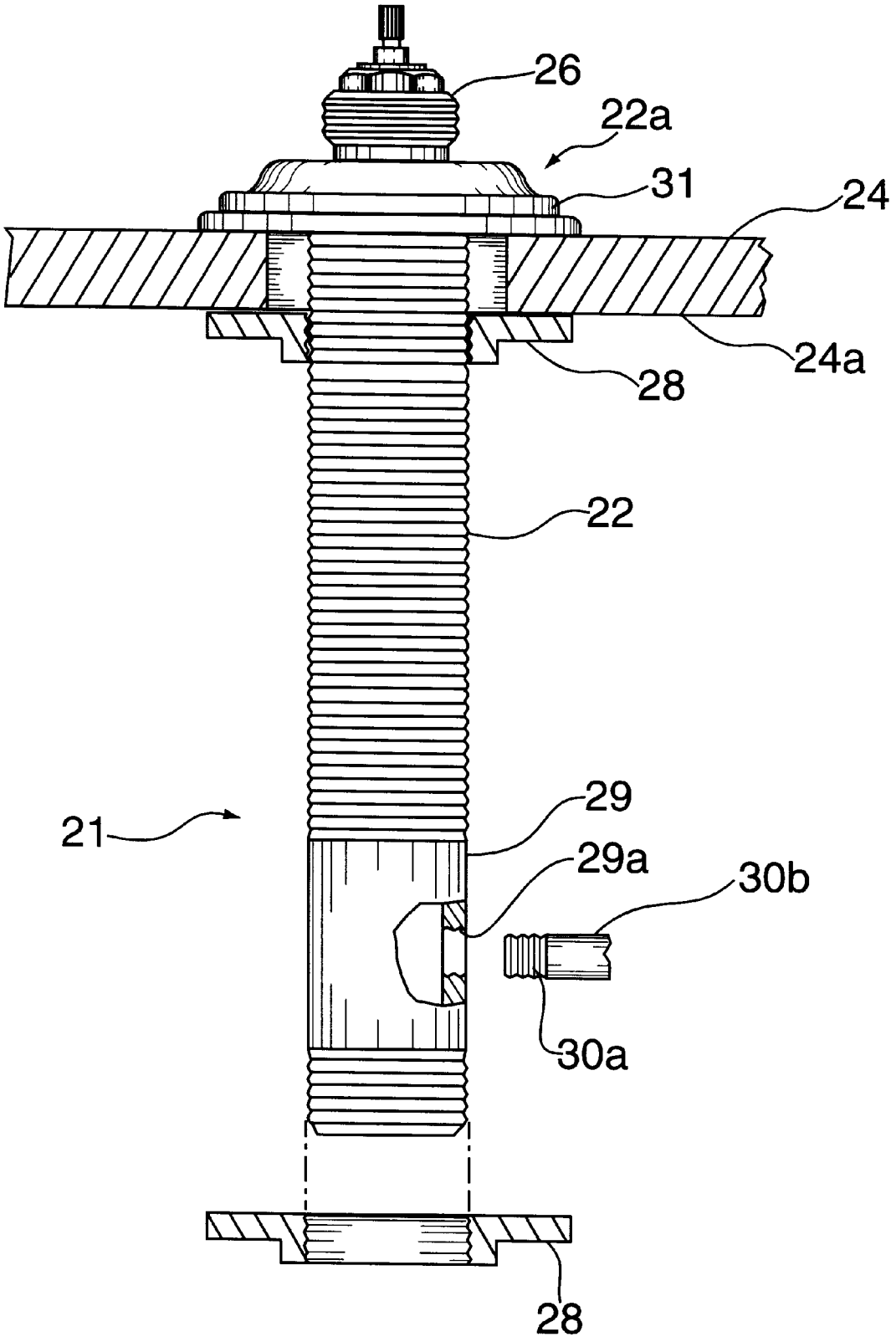
FIG. 4 is a side elevational view of the drop-in valve assembly of the present invention, as in FIG. 3 herein.

As shown in FIGS. 3 and 4, one side fitted embodiment of the drop-in faucet valve assembly 21 of the present invention includes outer cylindrical sleeve 22 having a first predetermined diameter D1 less than a second predetermined diameter D2 of hole 25 in sink countertop 24.

Drop-in valve assembly 21 includes valve 26 seated within a valve seat (not shown) of cylindrical sleeve 22.

Sleeve 22 includes a water flow fitting portion, such as a side fitting portion 29, having a third predetermined diameter D3 less than or equal to the diameter D1 of cylindrical sleeve 22. Side fitting portion 29 includes a female threaded portion 29*a* engageable with a water flow conduit, such as a male threaded portion 30*a* of coupling 30*b* of flexible outlet "hose" 30. As shown in FIGS. 3 and 4, water flow side fitting portion 29 extends coterminous with, and axially parallel to, cylindrical sleeve 22.

During installation, the sleeve 22 is first attached to an upper escutcheon 31 above sink countertop 24, and dropped into hole 25 in sink countertop 24. Escutcheon 31 restrains cylindrical sleeve 22 from going below a predetermined position within hole 25, so that an upper portion 22*a* of sleeve 22 extends above sink countertop 24 to install a faucet handle (not shown) thereon. Lock nut 28 is threaded over cylindrical sleeve 22, up to bottom 24*a* of countertop 24.

Coupling 30*b* of flexible outlet hose 30 is then threaded to female threaded portion 29*a* in side fitting 29 of valve assembly 21 from under sink countertop 24.

Figure 5:
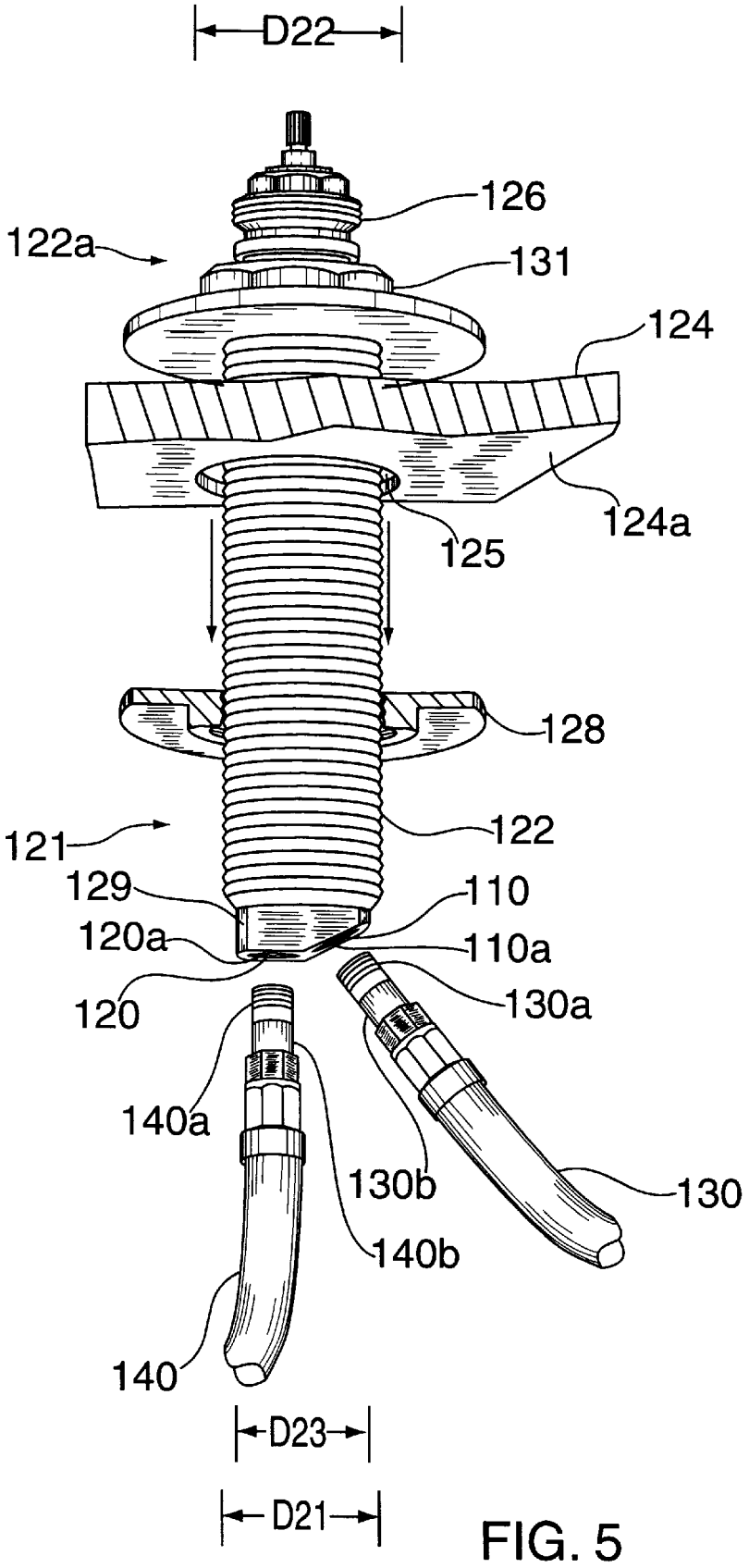
FIG. 5 is an exploded perspective view of another embodiment of the drop-in valve assembly of the present invention; and, FIG. 6 is a side elevational view of the drop-in valve assembly of the present invention, as in FIG. 5 herein.
Figure 6:
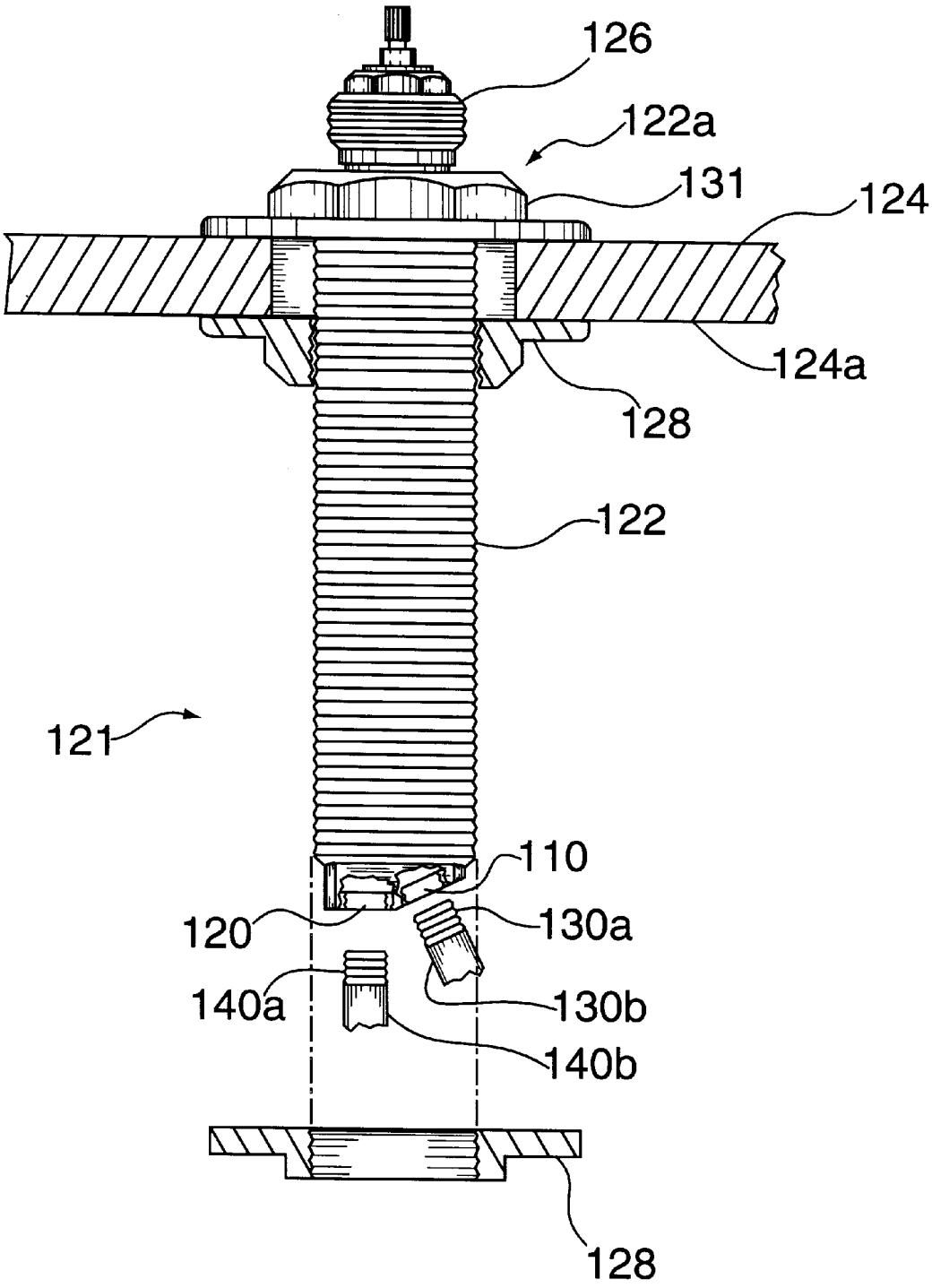

As shown in FIGS. 5 and 6, another bottom fitting embodiment of the drop-in faucet valve assembly 121 of the present invention includes outer cylindrical sleeve 122 also having a first predetermined diameter D21 less than a second predetermined diameter D22 of hole 125 in sink countertop 124.

Drop-in valve assembly 121 includes valve 126 seated within a valve seat (not shown) of cylindrical sleeve 122.

Sleeve 122 includes a water flow fitting portion, such as a bottom fitting portion 129, having a third predetermined diameter D23 less than or equal to the diameter D21 of cylindrical sleeve 122. Bottom fitting portion 129 includes a water flow portion such as a water outlet portion 110 with a female threaded portion 110*a* engageable with a further water flow portion, such as a male threaded portion 130*a* of coupling 130*b* of flexible outlet hose 130. Bottom fitting portion 129 also includes water inlet portion 120 with female threaded portion 120*a* engageable with a male threaded portion 140*a* of coupling 140*b* of flexible inlet hose 140. As shown in FIGS. 5 and 6, water flow bottom fitting portion 126 extends coterminous with, and axially parallel to, cylindrical sleeve 122.

During installation, the sleeve 122 is first attached to an upper escutcheon 131 above sink countertop 124, and dropped into hole 125 in sink countertop 124. Escutcheon 131 restrains cylindrical sleeve 122 from going below a predetermined position within hole 125, so that an upper portion 122*a* of sleeve 122 extends above sink countertop 124 to install a faucet handle (not shown) thereon. Lock nut 128 is threaded over cylindrical sleeve 122, up to bottom 124*a* of countertop 124.

Coupling 130*b* of flexible outlet hose 130 is then threaded to female threaded portion 11*a* in bottom fitting portion 129 of valve assembly 121 from under sink countertop 124. Furthermore, coupling inlet 140*b* of flexible inlet hose 140 is then threaded to female threaded portion 120*a* in water inlet portion 120 of bottom fitting portion 129.

It is known that other modifications can also be made to the drop-in valve of the present invention, without departing from the scope of the invention, as noted in the appended claims.

I claim:

1. A drop-in faucet valve assembly installable to a sink from above a sink countertop comprising:

an outer cylindrical sleeve, said outer sleeve having a first predetermined diameter less than a second predetermined diameter of a hole in the sink countertop, a valve being seated within said cylindrical sleeve;

said cylindrical sleeve including a water flow fitting portion having a third predetermined diameter less than or equal to said first predetermined diameter of said cylindrical sleeve;

said water flow side fitting portion extending coterminous with, and axially parallel to, said cylindrical sleeve, and, said water flow fitting portion including a pair of female threaded couplings engageable with a pair of flexible water flow conduits, a first coupling of said pair of couplings being obliquely oriented off of an axis of said cylindrical sleeve, and, a second coupling of said pair of couplings being oriented parallel to the axis of said cylindrical sleeve.

2. The drop-in valve assembly as in claim 1 further comprising an escutcheon holding said cylindrical sleeve in place above the sink countertop.

3. The drop-in valve assembly as in claim 1 further comprising a lock nut threadable over said cylindrical sleeve, said lock nut threadable up to a bottom of the countertop for holding said cylindrical sleeve in position within the hole in the sink countertop.

4. The drop-in valve assembly as in claim 1 wherein said water flow fitting portion extends from a side of said cylindrical sleeve.

5. The drop-in valve assembly as in claim 1 wherein said water flow fitting portion extends from a bottom of said cylindrical sleeve.

6. The drop-in valve assembly as in claim 1 wherein said at least one water flow conduit is a flexible hose.

7. The drop-in valve assembly as in claim 1 wherein one of said water flow conduits is a water inlet conduit.

8. The drop-in valve assembly as in claim 1 wherein one of said water flow conduits, is a water outlet conduit.

* * * * *